US011634979B2

(12) United States Patent
Srinivasan et al.

(10) Patent No.: US 11,634,979 B2
(45) Date of Patent: Apr. 25, 2023

(54) DETERMINING ONE OR MORE PARAMETERS OF A WELL COMPLETION DESIGN BASED ON DRILLING DATA CORRESPONDING TO VARIABLES OF MECHANICAL SPECIFIC ENERGY

(71) Applicants: Sridhar Srinivasan, Chennai (IN); William Dale Logan, Fulshear, TX (US)

(72) Inventors: Sridhar Srinivasan, Chennai (IN); William Dale Logan, Fulshear, TX (US)

(73) Assignees: Nextier Completion Solutions Inc., Houston, TX (US); Vorpal Energy Solutions, LLC., Houston, TX (US)

( * ) Notice: Subject to any disclaimer, the term of this patent is extended or adjusted under 35 U.S.C. 154(b) by 263 days.

(21) Appl. No.: 14/734,290

(22) Filed: Jun. 9, 2015

(65) Prior Publication Data

US 2016/0017696 A1 Jan. 21, 2016

Related U.S. Application Data

(60) Provisional application No. 62/026,199, filed on Jul. 18, 2014.

(51) Int. Cl.
*E21B 44/00* (2006.01)
*E21B 43/00* (2006.01)

(52) U.S. Cl.
CPC ..... *E21B 44/00* (2013.01); *E21B 43/00* (2013.01)

(58) Field of Classification Search
CPC ..... E21B 43/305; E21B 47/04; E21B 43/00; E21B 49/00; E21B 17/028; E21B 47/12;
(Continued)

(56) References Cited

U.S. PATENT DOCUMENTS 7,036,610 B1 * 5/2006 Vail, III ..... E21B 21/10 175/261
7,108,084 B2 * 9/2006 Vail, III ..... E21B 7/065 175/257

(Continued)

FOREIGN PATENT DOCUMENTS

CN 101305159 A * 11/2008 ..... E21B 45/00
CN 101305159 12/2008

(Continued)

OTHER PUBLICATIONS

Kline, B. "Advanced drilling and completion", 19th World Petroleum Congress, Spain 2008.*

(Continued)

*Primary Examiner* — Kandasamy Thangavelu
(74) *Attorney, Agent, or Firm* — Egan, Enders & Huston LLP.

(57) ABSTRACT

Methods for determining parameter/s of a well completion design (WCD) for at least a portion of a drilled well based on drilling data corresponding to variables of mechanical specific energy (MSE) are provided. In some cases, MSE values may be acquired and the WCD parameter/s may be based on the MSE values. The MSE values may be obtained from a provider or may be acquired by calculating the MSE values via the drilling data. In some cases, the data may be amended prior to determining the WCD parameter/s to substantially neutralize distortions of the data. In some cases, the methods may include creating a geomechanical model of the drilled well from acquired MSE values, optionally amending the geomechanical model and determining the WCD parameter/s from the geomechanical model. Storage mediums having program instructions which are executable by a processor for performing any steps of the methods are also provided.

27 Claims, 4 Drawing Sheets

(58) Field of Classification Search
CPC ..... E21B 21/08; E21B 43/26; E21B 7/065; E21B 21/10; E21B 12/02; E21B 12/00; E21B 44/00; G01V 11/00; G06Q 10/06; G06F 17/50
See application file for complete search history.

(56) References Cited

U.S. PATENT DOCUMENTS

| | | | | |
|---|---|---|---|---|
| 7,181,380 | B2 * | 2/2007 | Dusterhoft | E21B 49/006 166/250.07 |
| 7,325,617 | B2 | 2/2008 | Murray | |
| 7,857,047 | B2 * | 12/2010 | Remmert | E21B 12/02 175/57 |
| 7,953,587 | B2 | 5/2011 | Bratton et al. | |
| 9,228,425 | B2 * | 1/2016 | Ganguly | E21B 43/26 |
| 2004/0122640 | A1 | 6/2004 | Dusterhoft | |
| 2004/0220790 | A1 * | 11/2004 | Cullick | G06Q 10/06 703/10 |
| 2008/0105424 | A1 * | 5/2008 | Remmert | E21B 12/02 166/250.01 |
| 2010/0032165 | A1 * | 2/2010 | Bailey | G06F 17/50 166/369 |
| 2010/0088076 | A1 * | 4/2010 | Koutsabeloulis | E21B 43/00 703/2 |
| 2010/0191516 | A1 * | 7/2010 | Benish | E21B 43/00 703/10 |
| 2010/0299111 | A1 * | 11/2010 | Dale | E21B 49/00 703/2 |
| 2011/0011595 | A1 * | 1/2011 | Huang | E21B 43/00 166/369 |
| 2011/0162848 | A1 * | 7/2011 | Duffy | G01V 11/00 166/305.1 |
| 2011/0168391 | A1 * | 7/2011 | Saleri | G06Q 10/06 166/250.15 |
| 2011/0172976 | A1 * | 7/2011 | Budiman | E21B 47/04 703/2 |
| 2011/0214882 | A1 * | 9/2011 | Santos | E21B 21/08 166/373 |
| 2012/0067567 | A1 * | 3/2012 | Rytlewski | E21B 47/12 166/250.01 |
| 2012/0118636 | A1 * | 5/2012 | Koederitz | E21B 44/00 175/24 |
| 2013/0032401 | A1 * | 2/2013 | Edbury | E21B 7/06 175/24 |
| 2013/0048307 | A1 * | 2/2013 | Patel | E21B 17/028 166/377 |
| 2013/0105221 | A1 | 5/2013 | Wassell | |
| 2013/0140031 | A1 * | 6/2013 | Cohen | E21B 43/26 166/308.1 |
| 2013/0161096 | A1 | 6/2013 | Benson et al. | |
| 2013/0317798 | A1 * | 11/2013 | Cheng | E21B 43/305 703/10 |
| 2014/0277752 | A1 | 9/2014 | Chang et al. | |

FOREIGN PATENT DOCUMENTS

| | | | | |
|---|---|---|---|---|
| CN | 102687041 A * | 9/2012 | | E21B 44/00 |
| WO | WO 2013083380 A2 * | 6/2013 | | E21B 49/003 |
| WO | 2013/126074 | 8/2013 | | |

OTHER PUBLICATIONS

Newman et al., "How integrated well planning, technology and operations excellence impact ExxonMobil's development well results", SPE 2005.*
Flores et al., "Stimulation of geothermal wells, can we afford it?", Proceedings of World Geothermal congress, 2005.*
Nguyen et al., "An integrated approach using Geomechanics . . . to optimize reservoir productivity and stimulation design", SPE 2014.*
International Search Report & Written Opinion for PCT/US2015/036190 dated Oct. 14, 2015.
"Completions Optimized with Integrated Geomechanical Approach," © 2011 Schlumberger, 2 pages.
Caicedo et al., "Unique Bit Performance Predictor using Specific Energy Coefficients as a Function of Confined Compressive Strength Impacts Drilling Performance," © 2005 World Petroleum Congress, 26 pages.
"Engineered Completions Improve Eagle Ford Perforation Efficiency 28%,"©2013 Schlumberger, 2 pages.
Bevilacqua et al., "Acquisition, Processing and Evaluation of Down Hole Data for Monitoring Efficiency of Drilling Processes," Apr. 2013, Journal of Petroleum Science Research, vol. 2, Issue 2, pp. 49-56.
"Mangrove," © 2013 Schlumberger, 2 pages.
"PDC Mountaineer Improved Production more than 50% with Optimized Completion Designs," © 2014 Schlumberger, 2 pages.
"Mangrove Design Software Increases Total Stimulated vol. 25% in Marcellus Shale," © 2012 Schlumberger, 2 pages.
"Most Productive Zones of Niobrara Formation Targeted After Expert Log and Real-Time Data Interpretation," © 2013 Schlumberger, 2 pages.
"PetroChina Changqing Increases Initial Well Production Three-Fold in the Ordos Basin," © 2012 Schlumberger, 2 pages.
Waters et al., "Use of Horizontal Well Image Tools to Optimize Barnett Shale Reservoir Exploitation," © 2006 Society of Petroleum Engineers, pp. 1-13.
Mohan et al., "Tracking Drilling Efficiency Using Hydro-Mechanical Specific Energy," © 2009 SPE/IADC Drilling Conference and Exhibition, pp. 1-12.
Kok et al., "The Significance of Accurate Well Placement in the Shale Gas Plays," © 2010 Society of Petroleum Engineers, pp. 1-7.
Ejofodomi et al., "Integrating All Available Data to Improve Production in the Marcellus Shale," © 2011 Society of Petroleum Engineers, pp. 1-37.
Miller et al., "Evaluation of Production Log Data from Horizontal Wells Drilled in Organic Shales," © 2011 Society of Petroleum Engineers, pp. 1-23.
Wutherich et al., "Evaluating an Engineered Completion Design in the Marcellus Shale Using Microseismic Monitoring," ©2012 Society of Petroleum Engineers, pp. 1-10.
Macdonald et al., "A Multi-Domain Approach to Completion and Stimulation Design in the Marcellus Shale," © 2013 Unconventional Resources Technology Conference, pp. 1-10.
Ajisafe et al., "Engineered Completion Workflow Increases Reservoir Contact and Production in the Wolfcamp Shale, West Texas," © 2014 Society of Petroleum Engineers, pp. 1-11.
Teale, "The Concept of Specific Energy in Rock Drilling," 1965, Int. J. Rock Meeh. Mining Sci., vol. 2, pp. 57-73.
Kelessidis, "Rock drillability prediction from in situ determined unconfined compressive strength of rock," Jun. 2011, The Journal of The Southern African Institute of Mining and Metallurgy, vol. 111, pp. 429-436.
Office Action dated Feb. 22, 2107 for Canadian Patent Application No. 2,955,343.
Rule 71(3) Communication dated Jul. 20, 2017 for EP Patent Application No. 15 758 510.5-1614.
PCT/US2015/036190; Written Opinion, dated Jul. 18, 2016, 7 pgs.
PCT/US2015/036190; Transmittal of International Preliminary Report on Patentability; dated Oct. 27, 2016, 21 pgs.
PCT/US2015/036190; Corrected International Preliminary Reporton Patentability; dated Jan. 13, 2017, 21 pgs.
Patent Office of the Cooperation Council for the Arab States of the Gulf, "Examination Report" for GC Patent Application No. GC 2015-29733 dated Mar. 12, 2018, 3 pages.
Patent Office of the Cooperation Council for the Arab States of the Gulf, "Examination Report" for GC Patent Application No. GC 2015-29733 dated Aug. 6, 2018, 4 pages.
Canadian Intellectual Property Office, "Notice of Allowance" for Canadian Patent Application No. 2,955,343 dated Jan. 9, 2018, 1 page.
China National Intellectual Property Administration, "Office Action" for Chinese Patent Application No. 20150046456.4 dated Sep. 30, 2018, 10 pages.

(56) References Cited

OTHER PUBLICATIONS

The Eurasian Patent Organization, "Office Action" for Russian Patent Application No. 201790214 dated Oct. 24, 2018, 2 pages.
European Patent Office, "Search Report" for European Patent Application No. 18150844.1 dated Apr. 18, 2018, 7 pages.

* cited by examiner

DETERMINING ONE OR MORE PARAMETERS OF A WELL COMPLETION DESIGN BASED ON DRILLING DATA CORRESPONDING TO VARIABLES OF MECHANICAL SPECIFIC ENERGY

PRIORITY CLAIM

The present application claims priority to U.S. Provisional Application No. 62/026,199 filed Jul. 18, 2014.

BACKGROUND OF THE INVENTION

1. Field of the Invention

This invention generally relates to well drilling and completion and, more specifically, to methods for determining one or more parameters of a well completion design.

2. Description of the Related Art

The following descriptions and examples are not admitted to be prior art by virtue of their inclusion within this section.

Wells are drilled for a variety of reasons, including the extraction of a natural resource such as ground water, brine, natural gas, or petroleum, for the injection of a fluid to a subsurface reservoir or for subsurface evaluations. Before it can be employed for its intended use, a well must be prepared for its objective after it has been drilled. The preparation is generally referred to in the industry as the well completion phase and includes casing the drilled well to prevent its collapse as well as other processes specific to the objective of the well and/or the geomechanical properties of the rock in which the well is formed. For example, typical well completion processes for oil and gas wells may include perforating, hydraulic fracturing (otherwise known as "fracking") and/or acidizing.

In many cases, the efficacy of a well depends on the implementation of the well completion phase. For instance, it has been found that a well completed according to the geomechanical properties of rock along the trajectory of the well is generally more effective for its intended use than a well completed assuming the rock is homogeneous and isotropic. In particular, a wellbore used to extract a natural resource generally has higher production when it is completed based on geomechanical properties of the rock along its trajectory rather than when the rock is assumed to be homogeneous and isotropic. Designing a well completion phase based on geomechanical properties of rock, however, is time consuming and expensive, particularly in horizontal wells. Furthermore, return on investment is often unknown when designing a well completion phase based on geomechanical properties of rock. Given such uncertainty and the drive in the industry to reduce completion costs, most well operators choose to implement a well completion design which assumes the rock along a wellbore trajectory is homogeneous and isotropic.

Therefore, it would be advantageous to develop a method for determining one or more parameters of a well completion design for at least a portion of a drilled well that causes little or no delay between the drilling and completion phases of the well. It would be further beneficial for such a method to be relatively low cost and deliver higher efficacies relative to wells completed on the assumption that the rock along the wellbore trajectory is homogeneous and isotropic.

SUMMARY OF THE INVENTION

The following description of various embodiments of methods and storage mediums is not to be construed in any way as limiting the subject matter of the appended claims.

Embodiments of methods for determining one or more parameters of a well completion design for at least a portion of a drilled well based on drilling data corresponding to variables of mechanical specific energy (MSE) are provided. In some cases, the methods include acquiring values of mechanical specific energy (MSE) for at least the portion of the drilled well and determining one or more parameters of the well completion design based on the MSE values. In some cases, the MSE values may be obtained from a provider. In other embodiments, the MSE values may be acquired by obtaining data regarding a drilling operation of the well and calculating the values of MSE via the data. In any case, some of the drilling data may be amended prior to determining parameter/s of the well completion design to substantially neutralize distortions of the data which are not related to geomechanical properties of rock drilled in the well. In some embodiments, the methods may include creating a geomechanical model of at least the portion of the well from the acquired MSE values and determining one or more parameters of the well completion design from the geomechanical model. In some cases, the geomechanical model may be amended prior to determination of the one or more parameters of the well completion design to substantially neutralize distortions of MSE values resulting from drilling data which is not related to geomechanical properties of rock drilled in the well. In addition or alternatively, the geomechanical model may be amended in view of data that is not typically encompassed by the calculation of MSE. Storage mediums having program instructions which are executable by a processor for performing any steps of the disclosed methods are also provided.

BRIEF DESCRIPTION OF THE DRAWINGS

Other objects and advantages of the invention will become apparent upon reading the following detailed description and upon reference to the accompanying drawings in which.

Figure 1:
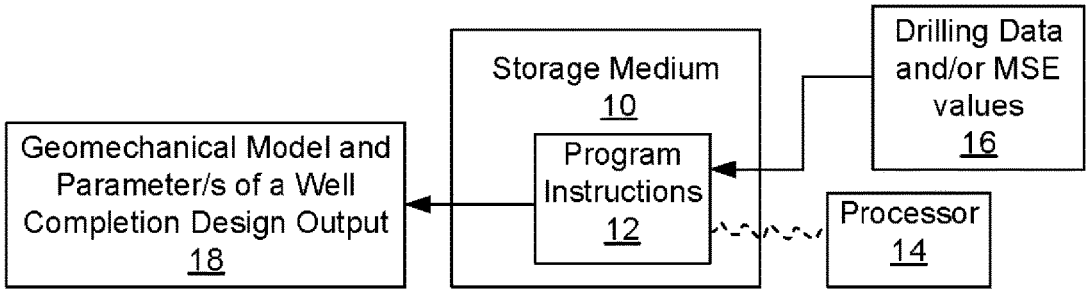
FIG. 1 is a schematic diagram of a storage medium having program instructions which are executable by a processor for processing input of drilling data and/or values of mechanical specific energy (MSE) of at least a portion of a drilled well and determining for output of one or more parameters and/or a geomechanical model for at least the portion of the well.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF THE PREFERRED EMBODIMENTS

Provided herein are methods and storage mediums having processor-executable program instructions for determining one or more parameters of a well completion design based on drilling data corresponding to variables of mechanical specific energy (MSE). In particular, the methods and storage mediums described herein take advantage of the close relationship between MSE and rock strength:

$$\text{Rock Strength} \approx \text{MSE} * \text{Deff} \quad \text{(Eq. 1)}$$

Where Deff=efficiency of transmitting the penetration power of the drilling rig to the rock and Rock Strength refers to various strength properties of rock, such as but not limited to unconfined compressive strength, confined compressive strength, tensile strength, modulus of elasticity, stiffness, brittleness and/or any combination thereof.

MSE is often computed and monitored in real time during a drilling operation of a well to maximize drilling efficiency (i.e., by keeping MSE as low as possible and the rate of penetration as high as possible via changes to drilling parameters such as weight on bit, revolutions per minute, torque and/or differential pressures or changing out the drill bit for a new or different bit). Given its correlation to rock strength, changes in MSE during a drilling operation of a well may be indicative of substantial changes in rock properties, but it is difficult to confirm such a cause due to the several possibilities which may induce drilling inefficiencies during a drilling operation (such as but not limited to dull or damaged bits, poor mud circulation, and/or vibrations). As such, MSE is generally not used to decipher reservoir properties within a well during a drilling operation. Rather, if knowledge of reservoir properties along a trajectory of a well is desired to enhance a drilling operation, other rock analysis techniques, such as gamma ray and compressive full waveform acoustic measurements are generally used.

The methods and storage mediums disclosed herein, however, differ from such practices in that variations of MSE are evaluated for the determination of parameter/s of a well completion design. In particular, it is well understood that one of the largest contributors to the variability of well production is the variation in stress between neighboring perforation clusters within a given stage (i.e., larger variations of stress between neighboring perforation clusters generally yield lower production). As such, the methods and the storage mediums described herein function to characterize the geological heterogeneity within relatively short portions of a well. In general, the methods and storage mediums described herein are based on the reasonable presumption that the Deff factor for a drilling rig will remain reasonably constant in a short interval (e.g., <500 feet) of the well, such as a hydraulic fracturing stage (also known as a frack stage). In doing so, MSE can be used as a reliable qualitative predictor of rock strength within a short interval of the well and, thus, zones of comparable rock strength can be identified for the placement of perforation clusters and/or the determination of other parameter/s of a well completion design.

As set forth in more detail below, the one or more parameters of a well completion design determined by the methods and storage mediums described herein may relate to perforating operations and/or fracking operations of the well completion design. In some cases, the methods and storage mediums disclosed herein may be used to create a geomechanical model based on MSE and then one or more parameters of a well completion design may be determined based on the geomechanical model. In general, parameters of perforating operations may include locations and/or quantities of perforation clusters. Parameters of fracking operations may include locations or lengths of fracking stages and/or parameters to induce hydraulic fracturing and/or to maintain fractures (e.g., required hydraulic horsepower, fracturing fluid selection, proppant type). It is noted that although the methods and storage mediums disclosed herein are described particularly in reference to well completion designs employing fracking operations, the methods and storage mediums are not necessarily so restricted. In particular, the methods and storage mediums disclosed herein may be employed to determine parameter/s of a well completion design which does not involve hydraulic fracturing operations. Furthermore, although the methods and storage mediums described herein concentrate on determining parameters of perforating operations and/or fracking operations of well completion phases, the methods and storage mediums described herein are not so limited. In particular, the methods and storage mediums described herein may be used to determine parameters of other operations of well completion phases, such as but not limited to the placement of fracturing sleeves.

Furthermore, although the methods and storage mediums disclosed herein are described particularly in reference to well completion designs for horizontal portions of wells (i.e., wells which are parallel to or are angled less than or equal to 45 degrees relative to the earth's surface), the methods and storage mediums may be additionally or alternatively used for vertical portions of wells (i.e., wells which are substantially perpendicular to or are angled between 45 degrees and 90 degrees relative to the earth's surface). Moreover, even though the methods and storage mediums disclosed herein are described particularly in reference to determining parameter/s of well completion designs for the extraction of petroleum from a well, particularly shale oil, the methods and storage mediums are not so limited. For example, the methods and storage mediums disclosed herein may be alternatively used for determining parameter/s of well completion design for the extraction of natural gas, brine or water from a well. In yet other cases, the methods and storage mediums disclosed herein may be used for determining parameters of a fluid disposal well.

Furthermore, although the methods and storage mediums disclosed herein are described herein for determining one or more parameters of a well completion design based on values of MSE, the methods and storage mediums need not be so limited. In particular, the methods and storage mediums disclosed herein may be used to determine one or more parameters of a well completion design based on any correlation of drilling data which corresponds to variables of MSE. As set forth in more detail below, MSE is defined as the energy input per unit rock volume drilled and is generally computed via two components, a thrust component and a rotary component. The emphasis of either of the two components changes for different drilling applications, lending to different MSE equations being employed. For example, horizontal portions of wells are often drilled using mud motors, variables of which affect the rotary component of MSE, particularly flow rate through the mud motor (e.g., gallons/minute), mud motor speed to flow ratio (e.g., revolutions per gallon) and differential pressure.

It was discovered during the development of the methods and storage mediums disclosed herein that the rotary component of an MSE equation including such mud motor variables often accounts for more than 99% of the total value of MSE and, thus, variables associated with a thrust component of the equation, such as weight on bit, may not contribute significantly to the MSE value in some cases. In light of this, it is contemplated that instead of determining one or more parameters of a well completion design based on values of MSE, methods and storage mediums could be developed to determine one or more parameters of a well completion design based on a rotary component of MSE. Alternatively, methods and storage mediums could be developed to determine one or more parameters of a well completion design based on a computation alternative to MSE, but which incorporates the rotary component of MSE. For example, a computation which assumes a constant value for the thrust component of MSE could be used.

It was further discovered during the development of the methods and storage mediums disclosed herein that in many cases rotational speed of a drill and flow rate of a mud motor often fluctuate very little while drilling a horizontal portion of a well and, thus, such variables could be assumed constant for some calculations. In light of such information, methods and storage mediums could be developed to determine one or more parameters of a well completion design based on some correlation of one or more of the remaining variables of the rotary component for MSE, such as rate of penetration and differential pressure. It is noted that while the aforementioned observations regarding variables associated with a thrust component of an MSE equation and minor fluctuations among rotational speed of a drill and flow rate of a mud motor are true for most drilling operations, they are not exclusively true for all drilling operations. Thus, reviewing the drilling data to determine whether such data regularities exist before use of the alternative computations set forth above may be prudent in some cases.

Regardless of the basis used to determine one or more parameters of a well completion design, one or more steps of the methods described herein may be computer operated and, thus, storage mediums having program instructions which are executable by a process for performing one or more of the method steps described herein are provided. In general, the term "storage medium", as used herein, refers to any electronic medium configured to hold one or more set of program instructions, such as but not limited to a read-only memory, a random access memory, a magnetic or optical disk, or magnetic tape. The term "program instructions" generally refers to commands within software which are configured to perform a particular function, such as receiving and/or processing drilling data and/or MSE values, creating a geomechanical model and/or determining one or more parameters of a well completion design as described in more detail below. Program instructions may be implemented in any of various ways, including procedure-based techniques, component-based techniques, and/or object-oriented techniques, among others. For example, the program instructions may be implemented using ActiveX controls, C++ objects, JavaBeans, Microsoft Foundation Classes ("MFC"), or other technologies or methodologies, as desired. Program instructions implementing the processes described herein may be transmitted over on a carrier medium such as a wire, cable, or wireless transmission link. It is noted that the storage mediums described herein may, in some cases, include program instructions to perform processes other than those specifically described herein and, therefore, the storage mediums are not limited to having program instructions for performing the operations described in reference to FIGS. 2-8.

A schematic diagram of storage medium 10 having program instructions 12 which are executable by processor 14 to determine one or more parameters of a well completion design based on drilling data corresponding to variables of MSE is illustrated in FIG. 1. As shown in FIG. 1, program instructions 12 are executable by processor 14 to receive drilling data and/or MSE values 16. In embodiments in which program instructions 12 receive MSE values, the MSE values may, in some cases, be acquired from a data file in a memory of a computer in which storage medium 10 resides. In yet other cases, the MSE values may be acquired from a separate entity, such as the drilling operator of a well, a separate software program, or an intermediary agency. In other cases, program instructions 12 may include commands to calculate MSE values from drilling data corresponding to variables of MSE received by program instructions 12. In yet other embodiments, program instructions 12 may include commands to correlate drilling data which correspond to variables of MSE in a manner other than calculating MSE. In either case, program instructions 12 may include commands to amend some of the drilling data prior to calculating MSE or correlating the data in another manner. In any case, the drilling data received by program instructions 12 may include raw field data (i.e., data collected while drilling the well) and/or data processed and/or amended from raw field data. Furthermore, in addition to including data which corresponds to variables of MSE, the drilling data may include data regarding a drilling operation of a well which does not correspond to variables of MSE. Moreover, regardless of whether program instructions 12 receives the drilling data and/or MSE values, the data/values may correspond to an entire well or may be for a portion of a well.

As shown in FIG. 1 and described in more detail below, program instructions 12 are executable by processor 14 to process the received drilling data and/or MSE values to determine one or more parameters of a well completion design and/or create a geomechanical model for at least the portion of a well for output 18. Output 18 may be displayed on a screen connected (i.e., wired or wireless connection) to a computer comprising storage medium 10 and/or may be sent to an accessible data file in memory of a computer comprising storage medium 10. In addition or alternatively, output 18 may be sent to a screen or memory of an electronic device connected to the computer comprising storage medium 10. In some cases, output 18 may be fixed information (i.e., output 18 may not be amended as displayed and/or within its data file). In yet other embodiments, however, output 18 may be changeable, either via a user interface of a computer comprising storage medium 10 or via additional program instructions of storage medium 10 or a different storage medium. Allowing output 18 to be changeable may be advantageous for fine tuning parameter/s of a well completion design and/or developing and saving different well completion designs based on output 18.

A more detailed description of manners in which drilling data and/or MSE values may be manipulated and/or evaluated to determine one or more parameters of a well completion design and/or create a geomechanical model for at least the portion of a well are provided below in reference to FIGS. 2-8. In addition, examples of parameters of a well completion design which may be determined from MSE values or data corresponding to variables of MSE are described in more detail below in reference to FIGS. 4-8. Although FIGS. 2-8 are described in reference to methods, any of such processes may be integrated into processor-executable program instructions and, thus, the processes described in reference to FIGS. 2-8 are interchangeable in reference to processor-executable program instructions for performing such processes.

Figure 2:
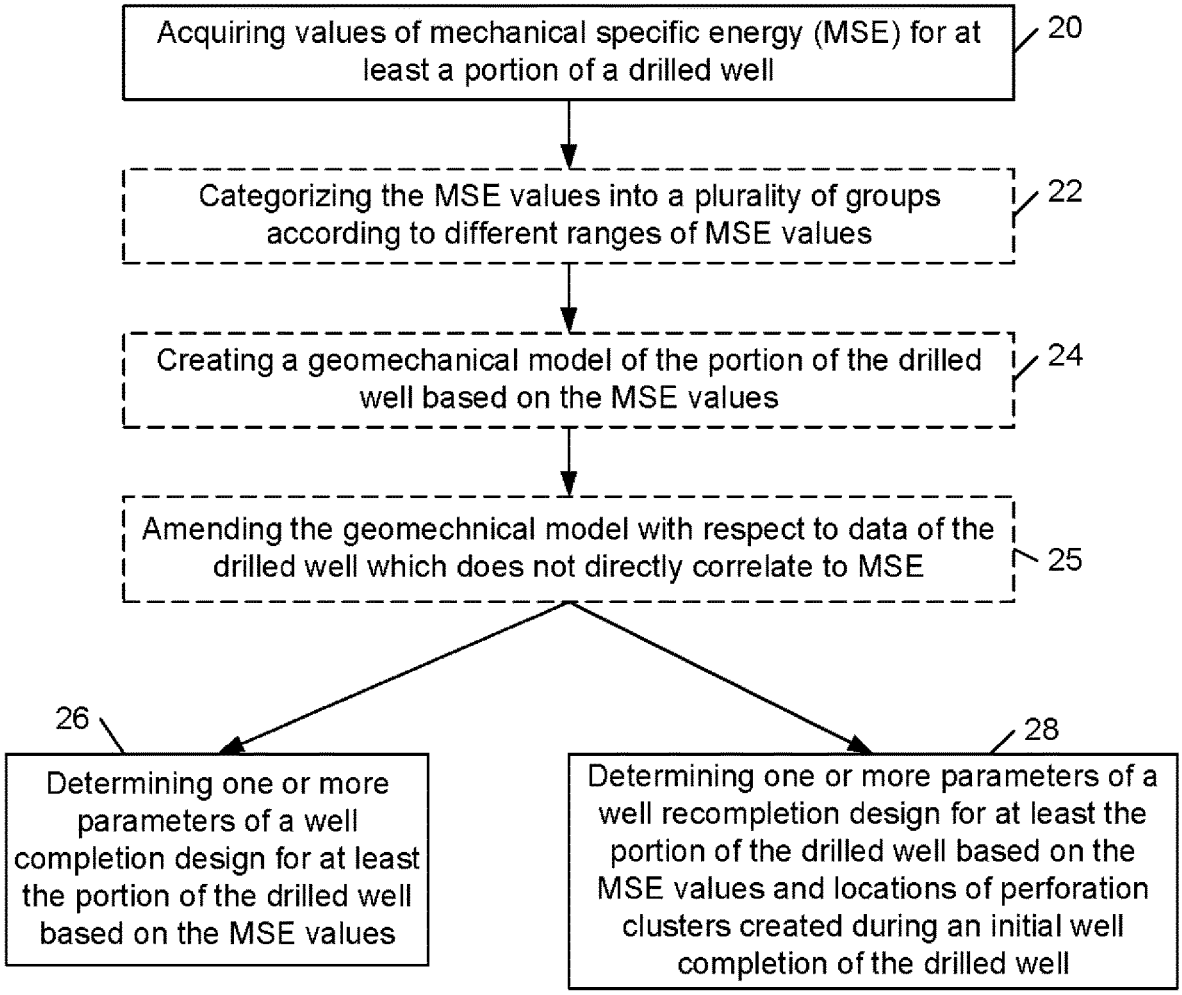
FIG. 2 is a flowchart of a method for acquiring MSE values for at least a portion of a drilled well and determining one or more parameters of a well completion design for at least the portion of the well.
Figure 3:
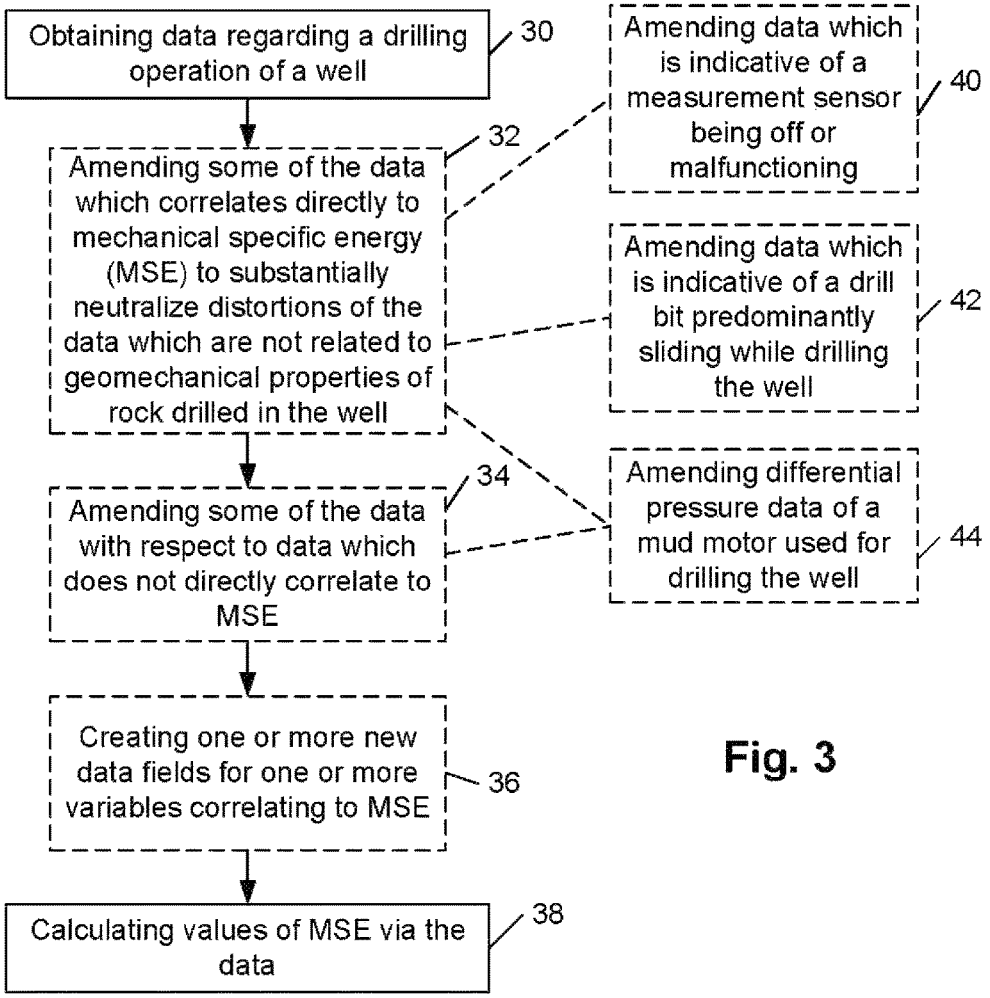
FIG. 3 is a flowchart of a method for obtaining data regarding a drilling operation of a well and calculating MSE values via the data.

Turning to FIG. 2, a flowchart of a method for determining one or more parameters of a well completion design for at least the portion of a well is illustrated. As shown in block 20, the method may include acquiring values of MSE for at least a portion of a drilled well. The term "acquire" as used herein is defined as the gain of information and is inclusive to both obtaining/procuring information from a separate entity or computing/determining the information based on received data. Thus, in some cases, the MSE values may be obtained from a separate entity, such as the drilling operator of a well, a separate software program, or an intermediary agency. In other cases, the MSE values may be calculated from drilling data corresponding to variables of MSE. A flowchart of this latter scenario is illustrated in FIG. 3 and described in more detail below denoting several optional steps for amending the obtained data prior to calculating values of MSE. Regardless of the manner in which MSE values are acquired, the drilling data and MSE values may correspond to an entire well or may be for a portion of a well. In some cases, it may be advantageous to limit the drilling data and/or MSE values to a corresponding area of interest of the well to minimize data processing. For example, the horizontal portion of a well may be an area of interest for the extraction of oil from shale rock. Likewise, a lowermost portion of a vertical well may be an area of interest for the extraction of water.

As noted above, FIG. 3 illustrates a flowchart of a method for calculating MSE values from drilling data. In particular, FIG. 3 shows block 30 in which data regarding a drilling operation of a well is obtained and block 38 in which values of MSE are calculated via the data. As similarly described in reference to block 16 of FIG. 1, the drilling data obtained at block 30 may include raw field data (i.e., data collected while drilling the well) and/or data processed and/or amended from raw field data. Furthermore, in addition to including data which corresponds to variables of MSE, the drilling data may include data regarding a drilling operation of a well which does not correspond to variables of MSE. In any case, the drilling data may be obtained from a separate entity, such as the drilling operator of a well, a separate software program or an intermediary agency. As noted above and explained in more detail below, different MSE equations are used for different drilling applications. Thus, the drilling data corresponding to variables of MSE may differ depending on the drilling operation of the well. In general, however, most MSE equations include variables of rate of penetration, rotary speed, weight on bit, applied torque and bit diameter or bit face area. Regardless of the MSE equation to be used it may be generally advantageous to limit the drilling data to operations in which the well is first being bored and exclude data not related to the initial formation of the well, such as drilling data corresponding to the removal of cement from a casing operation of the well.

As denoted by their dotted line borders, the method may include some optional blocks 32, 34 and 36 between blocks 30 and 38 to amend some of the data prior calculating values of MSE. It is noted that the any number of the processes described in reference to block 32, 34 and 36 may be performed prior to calculating MSE values in reference to block 38, specifically any one, two or all three processes. In cases in which more than one of the processes is conducted, the processes need not be conducted in the order depicted in FIG. 3. In fact, in some embodiments, two or more of the optional processes may be conducted simultaneously.

In any case, the method may include block 32 in which some of the data which correlates directly to MSE is amended to substantially neutralize distortions of the data which are not related to geomechanical properties of rock drilled in the well. Data which correlates directly to MSE as used herein refers to values for variables used to calculate MSE values. The distortions may be identified by first analyzing the obtained data for null values, negative values, spikes, missing sections of data and anomalous behavior. If any of such issues are found, it may be advantageous in some cases to analyze the data on either side of the issue, determine if other variables are having the same issue, and/or review gamma ray or mudlog lithology curves if available to determine the manner in which to amend the data to neutralize the distortion. In yet other cases, data may be amended per a predetermined rule, such as setting a rotational speed of the drill pipe (N) to zero when obtained values of N are less than a predetermined threshold as described in more detail below in regard to when the drill bit is sliding. Amendments may include removing data, substituting values from neighboring data (i.e., relative to the trajectory of the well) determined to be "good" or computing amendment values from linear averaging, extrapolation, and/or trend lines of the good neighboring data. In addition or alternatively, amendments may be derived from good data of other wells in the same basin, field or reservoir in which the well being evaluated for completion is formed. "Good data" as used herein refers to data which appears to be representative of a drill penetrating rock without distortions which are not related to geomechanical properties of the rock.

Blocks 40, 42 and 44 offer some examples of scenarios in which data can be amended to neutralize distortions of the data which are not related to geomechanical properties of rock drilled in the well. For example, block 40 denotes amending data which is indicative of a measurement sensor being off or malfunctioning. Another scenario in which data may be amended to neutralize distortions of the data which are not related to geomechanical properties of rock drilled in the well is when data is indicative of a drill bit predominantly sliding while drilling the well as denoted block 42. For example, rate of penetration (ROP) is generally very low during sliding operations. In such cases, since ROP is in the denominator of the MSE equation, low values of ROP will result in disproportionally high values of MSE. In order to neutralize such data, the ROP values may be amended using any of the manners described above or a minimum value may be set for ROP. In the latter cases, any obtained ROP data which falls below a particular threshold it may be changed to the preset minimum value.

Another variable of drilling data corresponding to MSE which may indicate when a drill bit is predominantly sliding while drilling the well is the rotational speed of the drill pipe (N). In some cases, a drill operator may oscillate the drill pipe during a sliding operation to reduce static friction, which produces small, but non-zero values of N. Since this movement of the drill pipe does not translate to additional rotational force at the bit and values of zero for N do not distort values of MSE relative to the scale of MSE computed for other portions of the well in which the drill bit is rotated, N may be set to zero when obtained values of N are less than a predetermined threshold. Yet another variable of drilling data which may indicate when a drill bit is predominantly sliding while drilling the well is torque and, thus, torque may be amended in response thereto.

In some cases, information may be received from a separate entity regarding regions of a well in which a drill bit was predominantly sliding during drilling of the well (i.e., in addition or alternative to the sliding regions being determined by analysis of the drilling data obtained in block 30). Such information may be received with the drilling data obtained in block 30 or may be received separate from such data. In either case, the sliding information may, in some embodiments, be validated by analyzing the drilling data corresponding to such regions. Upon identifying one or more regions of a well at which a drill bit was predominantly sliding while drilling the well (i.e., via received information and/or drilling data analysis), some of the drilling data corresponding to such identified regions may be amended to neutralize distortions of such data due to sliding operations. For example, rate of penetration, rotational speed of the drill pipe, or torque may be amended as described above. Yet another variable of drilling data that may be amended when one or more regions of a well are identified (i.e., via received information and/or drilling data analysis) as locations at which a drill bit was predominantly sliding while drilling the well is differential pressure of a mud motor used for drilling the well. In particular, differential pressure of a mud motor is typically lower in sliding regions than other regions of a well.

Another scenario in which differential pressure data may be amended to neutralize distortions of the data which are not related to geomechanical properties of rock drilled in the well is when differential pressure data has been calibrated to a value less than its target range during a drilling operation. In particular, it is standard practice in the drilling industry to recalibrate differential pressure several times during a drilling operation to set it within a range at which drilling efficiency may be better managed (i.e., through the monitoring of MSE). More specifically, the value of differential pressure during a drilling operation is often affected by conditions which do not correlate to the geomechanical properties of rock drilled in the well. As result, MSE values calculated using differential pressure data that is not recalibrated may be skewed and, hence, the MSE values will be less reliable for monitoring drilling efficiency. In some cases, the differential pressure is not calibrated to the target range and it must be recalibrated. In such cases, the first calibration often sets the differential pressure to very low or even negative values. Thus, it may be advantageous to amend such low differential pressure data using any of the manners described above or calibrate it with an offset as denoted in block 44 of FIG. 3.

Regardless of whether the obtained drilling data is amended to neutralize distortions of the data which are not related to geomechanical properties of rock drilled in the well (block 32), the method outlined in FIG. 3 includes an optional step in block 34 prior to computing values of MSE in block 38. In particular, block 34 specifies that some of the data (as obtained in reference to block 30 or amended in reference to block 32) may be amended with respect to data which does not directly correlate to MSE. Data which does not directly correlate to MSE as used herein refers to information which does not constitute the variables used to calculate MSE. There is a plethora of information that may be collected during a drilling operation of a well which does not include variables of MSE, but which correlates to rock strength or may be assumed to correlate to rock strength. Thus, some of the information may be used to fine tune values of MSE variables to yield MSE values which better represent the variation of rock strength along a trajectory of a well.

Such data may include but is not limited to directional data, mudlog data, logging while drilling (LWD), gamma ray measurements, as well as data from daily drilling reports. Other data that does not directly correlate to MSE but which may additionally or alternatively be used to amend some of the data obtained in reference to block 30 and/or the data amended in reference to block 32 is data from production logs and/or production history of one or more other wells in the same basin, field or reservoir in which the well being evaluated for completion is formed. Other data regarding the basin, field, or reservoir in which the well is being formed, such as geological cross section data, wireline log measurements or formation evaluation data, may additionally or alternatively be used to amend the data obtained in reference to block 30 and/or the data amended in reference to block 32. In addition or alternatively, any of such data (i.e., data which does not directly correlate to MSE) may be used to amend MSE values calculated in block 38 or more generally MSE values acquired in block 20 of FIG. 2.

Another optional process which may be conducted using the data obtained in reference to block 30 prior to the calculation of MSE values in block 38 is to create one or more new data fields and corresponding data for one or more of the variables used to calculate the MSE values as denoted in block 36. The one or more variables may be any of those used to calculate the MSE values. In some cases, the corresponding data of the one or more new data fields may be derived from data which does not directly correlate to MSE. For example as described in more detail below, corresponding data of a new data field for differential pressure (DIFP) data may be derived from standpipe pressure data. In other cases, the corresponding data of the one or more new data fields may be derived from data of one or more variable which directly correlate to MSE. In yet other embodiments, the corresponding data of the one or more new data fields may be derived from data of one or more variable which directly correlate to MSE and data which does not directly correlate to MSE. In any case, the corresponding data of the new data field may be used for the calculation of MSE values in reference to block 38 rather than using data of the corresponding variable obtained in reference to block 30. In other cases, the corresponding data of the new field may be used in combination with the data of the corresponding variable obtained in reference to block 30 for the calculation of MSE values in reference to block 38. For example, data obtained in reference to block 30 deemed to be "good data" could be used to calculate MSE values for the corresponding locations of the drilled well and the new field data could be used to calculate MSE values for other locations of the drilled well.

As noted above, an example of corresponding data of a new data field derived from data which does not directly correlate to MSE is a new data field for differential pressure derived from standpipe pressure. Standpipe pressure (SPP) as used herein refers to the total frictional pressure drop in a hydraulic circuit of a drilling operation using a mud motor. As set forth above, it is standard practice in the drilling industry to recalibrate differential pressure frequently during a drilling operation to set it within a range at which drilling efficiency may be better managed. If the DIFP is not calibrated to the target range, values of DIFP for those calibrations may be skewed. The issue occurs in sliding and rotating intervals of the drilling operation, but it is more difficult to detect in rotating intervals because DIFP values are higher and, thus, the changes in DIFP values can easily be misinterpreted as changes in rock properties. This can be problematic and lead to significant errors in reservoir evaluation if not handled properly, particularly for the determination of parameters of a well completion design.

During the development of the methods and storage mediums described herein, a relationship between SPP and DIFP was investigated. Both of these measurements contain a reservoir-related component (i.e., a portion which is representative of geomechanical properties of the rock formation being drilled) and a non-reservoir-related component (i.e., a portion which is not representative of the geomechanical properties of the rock formation being drilled). The non-reservoir component is impacted primarily by three effects: (1) the hydrostatic pressure caused by the column of fluid inside the drill pipe, which increases with true vertical depth, (2) changes in the flow rate from the mud pumps and (3) changes in density of the fluid inside the drill pipe (i.e., due to changes in the make-up of the drilling fluid) which will increase/decrease the hydrostatic pressure. It is the impact of these effects that causes a driller to re-calibrate the DIFP measurement repeatedly while drilling. In particular, recalibrating the differential pressure nulls the non-reservoir component of the variable, allowing the driller to monitor MSE values which are representative of the geomechanical properties of the rock formation being drilled and, thus, manage drilling efficiency better. As noted above, however, if DIFP is calibrated to a value less than the target range, the resulting changes DIFP values can be misinterpreted as changes in geomechanical properties for the purposes of reservoir evaluation and, thus, could lead to less than optimum parameters for well completion designs. Thus, it may be desirable to void or offset these unpredictable calibration events from DIFP measurements.

One manner for doing so is to create new data field for DIFP and derive data for it from standpipe pressure. In particular, SPP data obtained in reference to block 30 may be amended in light of the three effects noted above. More specifically, the effect of increasing hydrostatic pressure on SPP measurements relative to the true vertical depth of the drill pipe may be subtracted from the SPP values. In addition, SPP values may be amended to negate changes in mud pump flow rate. In particular, SPP values may be amended in proportion to increases or decreases in mud pump flow rate. Furthermore, SPP values may be amended to accommodate changes in fluid density in the drill pipe. More specifically, increases/decreases in fluid density in the drill pipe will increase/decrease hydrostatic pressure within the line and, thus, will affect the amount subtracted from the SPP values with respect to the level of hydrostatic pressure in the line. Each of the amended SPP values may then be modified by a set amount such that at least some of their values match DIFP values obtained during good recalibration events (i.e., not calibrations which reset DIFP to a value less than the target range) in the drilling operation of the well. In this manner, most of the modified SPP values will be in the DIFP range that the driller was attempting to maintain during the drilling operation of the well without data skewed by calibration events to particularly low values or being affected by hydrostatic pressure in the pipe or changes in mud flow rate or fluid density. The modified SPP values may be saved to the new DIFP data field, which will be used for the calculation of MSE in reference to block 38. The result is reliable DIFP values that deliver superior MSE calculations.

As shown in block 38, values of MSE may be calculated via the drilling data (i.e., the drilling data as obtained in reference to block 30, the drilling data amended in reference to block 32 and/or block 34 and/or the new data field/s created in reference to block 36). As noted above, MSE equations are used for different drilling applications and thus, the MSE equation used in reference to block 38 will depend on the type of wellbore as well as the parameters and equipment used to form the wellbore. The concept of MSE was first published by Teale in 1965 having two components, a thrust component and a rotary component. The thrust component $e_t$ was stated as:

$$e_t = \text{Force/Area} = \text{WOB}/\pi r^2 = \text{WOB}/\pi(D/2)^2 = 4\text{WOB}/\pi D^2 \quad \text{(Eq. 2)}$$

The rotary component $e_r$ was stated as:

$$e_r = (2\pi/A)(NT/u) \quad \text{(Eq. 3)}$$

$$= (2\pi/\pi(D/2)^2)*(N*T)/(ROP/60) \quad \text{(Eq. 4)}$$

$$= (2*4*60)(NT/\pi D^2 ROP) = 480NT/\pi D^2 ROP \quad \text{(Eq. 5)}$$

Thus, a basic MSE equation may be set forth as:

$$MSE_{(psi)} = \frac{4*WOB}{\pi D^2} + \frac{480*N*T}{D^2*ROP} \quad \text{(Eq. 6)}$$

where
WOB=Weight on Bit (k·lbs)
N=Rotational Speed (rev/min)
T=Torque (k·ft-lbs)
D=hole diameter (inches)
ROP=rate of penetration (ft/hr)

Equation 6 is well suited to drilling in vertical wells. However, horizontal wells involve the use of a mud motor which changes the rotary component of the equation. The rotation seen at the bit is instead the sum of the rotation of the pipe (N) and the rotation of the mud motor:

$$N' = N + Kn*Q \quad \text{(Eq. 7)}$$

where
Kn=Mud motor speed to flow ratio (rev/gal)
Q=Total Mud flow rate (gal/min)
N=Rotational Speed of drill pipe (rev/min)

The torque seen at the bit is also effected by the mud motor and may be defined as, $$T = (T\text{max}/P\text{max})*\Delta P \quad \text{(Eq. 8)}$$

where
Tmax=Mud Motor max-rated torque (ft-lb)
Pmax=Mud Motor max-rated ΔP (psi)
ΔP=Differential Pressure (psi)

Thus, an MSE equation for a well in which a mud motor is used may be set forth as:

$$MSE_{(k-psi)} = \frac{4*WOB}{\pi D^2} + \frac{480(N + Kn*Q)*((T\max/\Delta P\max))*\Delta P/100}{D^2 ROP} \quad \text{(Eq. 9)}$$

Alternatively, the torque seen at the bit may be determined downhole while drilling (i.e., via additional hardware) and, thus, Equation 9 may be modified to include torque as a variable instead of the correlation of Tmax, Pmax and ΔP. In addition or alternatively, an MSE equation including a hydraulic component may be considered for the methods and storage mediums described herein.

Although not depicted in FIGS. 2 and 3, any of the data and MSE values described in reference to blocks 20, 30, 32, 34, 36, 38, 40, 42, and 44 may be averaged over a given distance along a trajectory of the well. In particular, drilling data is typically sampled at a rate of one sample per foot and if MSE values are calculated to evaluate the efficiency of the drilling operation, the calculations are generally conducted in real time at the same rate. Such an amount of data, however, can cause too much noise in the analysis of the data and/or the evaluation of MSE values for determining parameters of a well completion phase, particularly for a horizontal portion of a well. As such, in some cases, the drilling data (raw or amended) and/or the acquired MSE values may be averaged over a given distance along a trajectory of the well, such as a few feet, particularly less than approximately 5 feet and in some cases about approximately 3 feet for a horizontal portion of a well. Averaging over a shorter distance may be warranted in a vertical portion of well to achieve better vertical resolution. In other embodiments, the drilling data obtained at block 30 or the MSE values acquired at block 20 may be averaged values obtained from a separate entity. In yet other cases, the drilling data (raw or amended) or the acquired MSE values may not be previously or subsequently averaged.

In any case, an optional process denoted in FIG. 2 is categorizing the MSE values acquired in block 20 into a plurality of groups according to different ranges of MSE values as shown in block 22. Categorizing the MSE values in such a manner allows the determination of one or more parameters of a well completion design to be simplified (i.e., take less time) in that it is based on the groups to which the MSE values are categorized rather than individual MSE values. Although such a process will homogenize the variability of rock properties along the well, it was determined during the development of the methods and storage mediums disclosed herein that the benefit of simplifying the determination of parameter/s of the well completion design often outweighs having a finer granularity of rock properties delineated for a well. In some cases, however, it is contemplated that a finer granularity of rock properties will be advantageous and, thus, the determination of one or more parameters of a well completion design may be based on individual MSE values. It is noted that the degree of homogenization incurred by the process denoted in block 22 will be dependent on the number of groups to which MSE values are categorized. An example listing of groups to which MSE values may be categorized is shown in Table 1 below, but the methods and storage mediums described herein are not necessarily restricted to categorizing MSE values into 14 groups or in the range of MSE values listed in Table 1. In particular, any plurality of groups and designations of MSE values may be used to categorize MSE values for the process denoted in block 22. In any case, the different ranges of MSE values for the designated groups represent different facies of rock.

TABLE 1

Grouping Index for MSE

| Group | MSE Range (Ksi) |
|---|---|
| HD1 | 0-14 |
| HD2 | 15-29 |
| HD3 | 30-49 |
| HD4 | 50-74 |
| HD5 | 75-99 |
| HD6 | 100-124 |
| HD7 | 125-149 |
| HD8 | 150-174 |
| HD9 | 175-199 |
| HD10 | 200-224 |
| HD11 | 225-249 |
| HD12 | 250-299 |
| HD13 | 300-399 |
| HD14 | 400-500 |

As noted above, the methods and storage mediums described herein are based on the presumption that the efficiency of a drilling rig to penetrate rock will remain reasonably constant in a short interval (e.g., <500 feet) of the well. As such, the methods and storage mediums described herein may include individually analyzing different subsets of the acquired MSE values in block 20 or the MSE values categorized in block 22 that respectively correspond to different sections of the drilled well. In doing so, MSE can be used as a reliable qualitative predictor of rock strength within a short interval of the well and, thus, zones of comparable rock strength can be identified for the placement of perforation clusters and/or the determination of other parameter/s of a well completion design via the individualized analysis. In order to facilitate such individual analysis, the MSE values or the groups to which MSE values are categorized may be mapped with locations of the drilled well associated with the MSE values (i.e., the locations of the drilled well for which the MSE values were acquired or calculated based on the drilling data derived at such locations). The term "mapped" in such a context refers to a matching process where the points of one set are matched against the points of another set. A geomechanical model of the mapped values/groups in succession relative to a trajectory of the drilled well may be created as a result of the mapping process or may be created from the mapped values/groups as shown by block 24 in FIG. 2. The term geomechanical model as used herein refers to a correlation of relative geomechanical properties of one or more rock formations along a cross section of the rock formation/s. The term encompasses a database of mapped values/groups as well as a pictorial representation of the geomechanical properties.

In any case, subsets of a geomechanical model may in some embodiments be demarcated to respectively correspond to different sections of the drilled well. The geomechanical model may be demarcated based on a set length/s of sections of the drilled well (e.g., 100-500 foot sections) and/or may be demarcated at boundaries of neighboring groups to which the MSE values are categorized. In general, demarcation of the geomechanical model may be advantageous for facilitating individual analysis of the mapped MSE values/groups in short intervals to determine one or more parameters of a well completion design for each of the different sections of the drilled well. In some cases, the determination of parameter/s of a well completion design for a particular section of a drilled well may include analyzing mapped values/groups of one or both of the subsets neighboring the respective subset of the geomechanical model. In other embodiments, however, the geomechanical model need not be demarcated, but rather the methods and storage mediums may be configured to arbitrarily analyze subsets of the MSE values/groups within relatively short intervals to determine parameter/s of a well completion design.

Regardless of the type of geomechanical model created for the MSE values/groups, a geomechanical model may in some cases be amended with respect to data which does not directly correlate to MSE as shown in block 25. In particular, a geomechanical model may, in some cases, be amended to incorporate data which does not directly correlate to MSE. In addition or alternatively, a geomechanical model may be amended in light of data which does not directly correlate to MSE, such as to denote areas of interest or areas to potential problems in light of information gleaned from the data. Similar to the optional amendment process described in reference to block 34 of FIG. 3, there may be a plethora of information that is collected during a drilling operation of a well which do not include variables of MSE, but which may be used to fine tune a geomechanical model to better determine one or more parameters of a well completion design. The data which does not directly correlate to MSE may correlate to rock strength of a rock formation and/or may correlate to other facets of the rock formation. For example, logging while drilling (LWD) data may be used to identify water zones in rock formations.

In general, data which does not directly correlate to MSE that may be used to amend a geomechanical model to better determine one or more parameters of a well completion design may include but is not limited to directional data, mudlog data, LWD, gamma ray measurements, as well as data from daily drilling reports. For example, as noted above, LWD may be used to identify water zones in rock formations and that information may be used to amend the geomechanical model to denote the areas in which the water zones reside. As a result, a well completion design may be created which avoids placement of perforation clusters in such areas. Other data that does not directly correlate to MSE but which may additionally or alternatively used to amend a geomechanical model is data from production logs and/or production history of one or more other wells in the same basin, field or reservoir in which the well being evaluated for completion is formed. Other data regarding the basin, field, or reservoir in which the well is being formed, such as geological cross section data, wireline log measurements, or formation evaluation data, may additionally or alternatively used to amend a geomechanical model.

In many cases, drill bits are changed during a drilling operation. Such changes often cause a skew in drilling data that is not a result of changes in the geomechanical properties of the rock. As a consequence, MSE values calculated for portions of a well forward and behind locations at which a drill bit was changed may be skewed relative to each other. In view of this, the methods and storage mediums described herein may, in some embodiments, denote drilling data, MSE values, portions of groups to which MSE values are categorized, or portions of a geomechanical model which correspond to a location along the well at which a drill bit was changed during the drilling operation. Information regarding such locations may be received from a separate entity and may be received with or separate from the drilling data or acquired MSE values. Such a denotation may be advantageous for discounting the data/values as part of the analysis for the determination of parameter/s of the well completion design, particularly if there is a significant change in drilling data or MSE values at a location at which a drill bit is changed. For example, the methods and storage mediums described herein may evaluate drilling data/MSE values/MSE groups forward a location at which a drill bit was changed separately from drilling data/MSE values/MSE groups backward from the location. The amount of drilling data/MSE values/MSE groups to be separately evaluated forward and backward of the drill bit change location may vary among applications. An example amount may correspond to approximately 50 feet to approximately 100 feet of the drilled well.

As shown by blocks 26 and 28 in FIG. 2, the method may include determining one or more parameters of a well completion design or a well recompletion design for at least a portion of a drilled well. A well completion design as used herein refers to a plan proposed for at least some parts of a completion phase of a borehole. A well recompletion design as used herein is a term encompassed by the term well completion design and refers to plan proposed for recompleting a borehole in zones different from the zones initially completed in the borehole. As known in the art, a well recompletion phase includes plugging perforations in the zones initially completed in the borehole prior to forming perforations in the different zones. As such, the determination of parameter/s of a well recompletion design for the methods and storage mediums described herein are not only based on MSE values corresponding to the portion of the well of interest, it is based on locations of perforation clusters created during an initial well completion of the drilled well as denoted in block 28 of FIG. 2. Block 26 denotes the determination of parameter/s of the more broadly characterized term well completion design to be based at least on MSE values corresponding to a portion of a well of interest and, thus, block 26 covers scenarios for initial well completion designs as well as well recompletion designs. In some cases, the determination of parameters of an initial well completion design may be based solely on MSE values corresponding to a portion of a well of interest as described in more detail below in reference to FIGS. 4-8.

FIGS. 4-8 illustrate portions of a geomechanical model having different parameters of a well completion design for the same well. Only a portion of the geomechanical model is shown in the interest to emphasize the determination of operating parameters for the well completion designs based on the MSE values corresponding to the depicted portion of the well. In particular, FIGS. 4-8 only depict five subsets of the geomechanical model, but geomechanical models with fewer or more subsets may be created using the methods and storage mediums described herein. The MSE values corresponding to the depicted portion of the well in FIGS. 4-8 have been categorized into groups according to Table 1 and are coded according to the color chart provided in the models. Other coding techniques may be employed and, thus, the geomechanical models created via the method and storage mediums described herein are not limited to color indices of MSE groups. As noted above, the different ranges of MSE values for the designated groups represent different facies of rock and, as such, the colors coded in the geomechanical models depicted in FIGS. 4-8 represent the array of facies along the depicted portion of the well.

Figure 4:
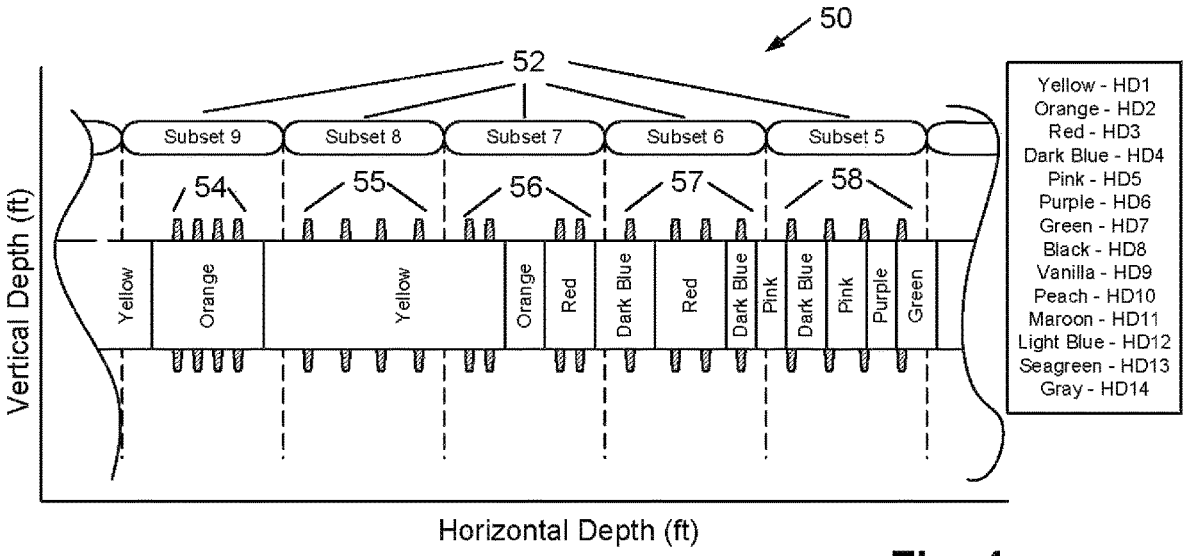
FIG. 4 is a portion of a geomechanical model in which locations of perforation clusters of a well completion design have been designated based on MSE values corresponding to a drilling operation of a well.

Turning to FIG. 4, geomechanical model 50 is shown geometrically divided into subsets 52 of equal length. Such a geometrical demarcation is not based on MSE values of the well, but rather on the distance of the portion of the well designated for the well completion. In some cases, subsets 52 may be fracking stages (i.e., if hydraulic fracturing is part of the well completion design). In such embodiments, the geometrical demarcation of the stages may be further based on the number stages predetermined for the portion of the well. In other cases, however, subsets 52 may simply be stages for forming perforation clusters when hydraulic fracturing is not part of the well completion design. Such a scenario will generally more applicable for vertical portions of wells. As shown in FIG. 4, each of subsets 52 has a set of four perforation clusters designated at different locations within the respective subset. In such an embodiment, the number of perforation clusters for such a subset is predefined and not based on the MSE values corresponding to the depicted portion of the well. However, the locations of the perforation clusters are based on the groups to which the MSE values corresponding to the depicted portion of the well are categorized. In particular, the methods and storage mediums disclosed herein may designate perforation clusters to locations within each subset that have similar MSE values.

In some cases, the designation process may include designating perforation clusters at locations within a subset corresponding to two different groups of MSE values (i.e., facies) as shown by perforation clusters 56 and 57 in FIG. 4. In yet other embodiments, all of the perforation clusters may be designated at locations within a subset having associated MSE values of the same group as shown by perforation clusters 54 and 55 in FIG. 4. In particular, subsets 8 and 9 in FIG. 4 have MSE groups (i.e., yellow and orange MSE groups respectively) of sufficient length to accommodate a number of perforation clusters set for each subset of the well. In contrast, the MSE groups in subsets 6 and 7 are not of sufficient length to accommodate the predefined number of perforations clusters for the subsets and, thus, perforation clusters 56 and 57 are divided among two groups of MSE values (i.e., perforation clusters 57 are divided among dark blue and red MSE groups in subset 6 and perforation clusters 56 are divided among red and yellow MSE groups in subset 7).

Perforation clusters 58 in subset 5 in FIG. 4 differ from perforation clusters 54-57 in that they are geometrically divided with equal spacing within subset 5 rather than being based on the MSE groups in the subset. In particular, it was determined during the evaluation of geomechanical model 50 that none of the preset number of four perforation clusters for subset 5 could be designated at locations having MSE values of the same group or among two groups and, thus, the location of the perforation clusters was defaulted to a geometrical arrangement of equal spacing. Alternatively, each of the perforation clusters of subset 5 could be assigned a location corresponding to a different MSE group of the subset. In other embodiments, the methods and storage mediums described herein may decategorize the MSE values of subset 5 and then either recategorize them into groups having larger ranges of MSE to create MSE groups in subset 5 of larger lengths to accommodate more than one perforation cluster or analyze the MSE values individually after their decategorization to determine four locations within subset 5 that have similar MSE values. In any case, subset 5 could be marked in the geomechanical model as one in which production is anticipated to be low due to the high variation of rock properties within the subset. Furthermore, it is noted that the determination of perforation cluster locations in any of subsets 52 may be confined to a set distance from the borders of subsets 52 such that a section of the drilled well may be adequately sealed off for the formation of perforation clusters and/or a hydraulic fracturing process without coming in proximity to a perforation cluster.

Figure 5:
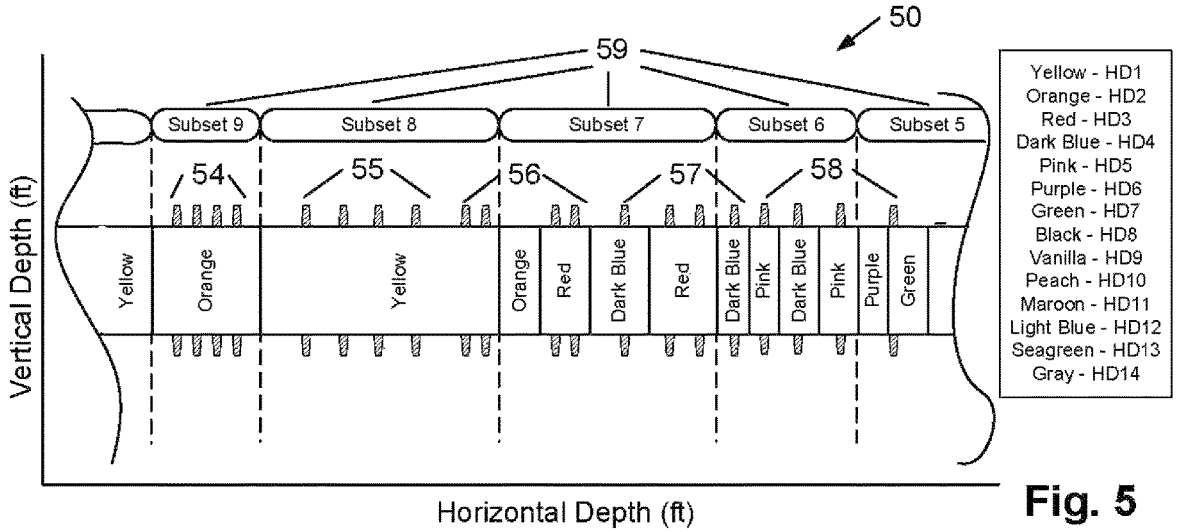
FIG. 5 is the portion of the geomechanical model depicted in FIG. 4 subsequent to the lengths of subsets of the geomechanical model being amended.

Subsequent to designating locations of perforation clusters for a well completion design, the demarcation of subsets 52 of geomechanical model 50 in FIG. 4 may in some cases be amended, particularly based on the groups to which the MSE values of each subset are categorized as well as the designated locations of the perforation clusters. FIG. 5 illustrates geomechanical model 50 of FIG. 4 subsequent to such amendment, particularly having newly demarcated subsets 59. As shown, the locations of perforation clusters 54-58 are the same as those depicted in FIG. 4, but the demarcations of subsets 59 have changed. In particular, the subsets have been demarcated at interfaces of neighboring MSE groups. Alternatively stated, the subsets have been demarcated at positions in geomechanical model 50 corresponding to boundaries of neighboring facies in the drilled well since the coded MSE groups represent different facies of rock. More specifically, subset 9 has been demarcated over the orange MSE group comprising perforation clusters 54, particularly at the interfaces of its neighboring yellow MSE groups. Similarly, subset 8 has been demarcated over the yellow MSE group comprising perforation clusters 55, particularly at the interfaces of its neighboring orange MSE groups. In doing so, two of perforation clusters 56 are now located in subset 8, which is likely to be beneficial given the increased size of subset 8 (i.e., it may be sensible to have more perforation clusters in a subset of greater length to optimize production from the subset). It is further advantageous that the two perforation clusters 56 now located in subset 8 are categorized in the same MSE group as perforation clusters 55, increasing the likelihood of greater production from the subset.

As further shown in FIG. 5, subset 7 has been moved and lengthened relative to its demarcation in FIG. 4 to extend across four MSE groups, particularly having its respective borders demarcated at interfaces between yellow and orange MSE groups and red and dark blue MSE groups. The amended demarcation of subset 7 includes three of perforation clusters 57, two of which are categorized to the red MSE group, which pairs well with the two perforation clusters 56 positioned along the other red MSE group in subset 7 to optimize production from the subset. The third perforation cluster of perforation clusters 57 in subset 7 located in the dark blue MSE group is the lone perforation cluster in subset 7 for such a facies. In some cases, the third perforation cluster of perforation clusters 57 in subset 7 may be removed from geomechanical model 50 due to its variance of MSE values from the other perforation clusters in the subset. In other embodiments, however, the third perforation cluster of perforation clusters 57 in subset 7 may be retained in geomechanical model 50 since the red and dark blue MSE groups neighbor each other along the scale of MSE groups. In yet other cases, subset 7 may be amended (i.e., relative to geomechanical model 50 in FIG. 4 or FIG. 5) to include the dark blue MSE group of subset 6 interposed between red and pink MSE groups. In particular, the perforation cluster located in the noted dark blue MSE group in subset 6 may pair well with the perforation cluster located in the dark blue MSE group of subset 7 to optimize production from the subset.

In other embodiments, the dark blue MSE group may be retained in subset 6 if subset 6 is amended relative to geomechanical model 50 in FIG. 4. In particular, FIG. 5 illustrates subset 6 moved relative to its demarcation in FIG. 4 to extend across two dark blue MSE groups and two pink MSE groups, particularly having its respective borders demarcated at interfaces between red and dark blue MSE groups and pink and purple MSE groups. The amended demarcation of subset 6 shown in FIG. 5 includes one of perforation clusters 57 and three of perforation clusters 58. The amended demarcation of subset 6 facilitates a balance of the perforation clusters among the dark blue and pink MSE groups, increasing the likelihood of greater production from the subset. Lastly, FIG. 5 illustrates subset 5 moved such that one of its borders is demarcated at the interface between the pink and purple MSE groups. The extent of subset 5 is not illustrated in FIG. 5 since it spans into a portion of geomechanical model not shown in FIG. 5. One of perforation clusters 58 is retained within amended subset 5 in FIG. 5 and may be used as basis for determining its span. In other embodiments the lone perforation cluster 58 may be removed from geomechanical model 50 and perforation clusters may be redesignated for subset 5 based on the amended demarcation of the subset.

As with the determination of perforation cluster locations described in reference to FIG. 4, the amendments to the subset demarcations described in reference to FIG. 5 may be restricted to insure the perforation cluster locations are a set distance from the borders of subsets 59. In alternative embodiments, however, perforation cluster locations may be amended to comply with the distance requirement after the subset demarcation amendments have been made. In any case, it is noted that subsets 52 of FIG. 4 may be amended in a different manner than reflected for subsets 59 in FIG. 5, particularly that the borders of the subsets may be demarcated to different interfaces between neighboring facies along the well or even demarcated to a location within a single facie.

Figure 6:
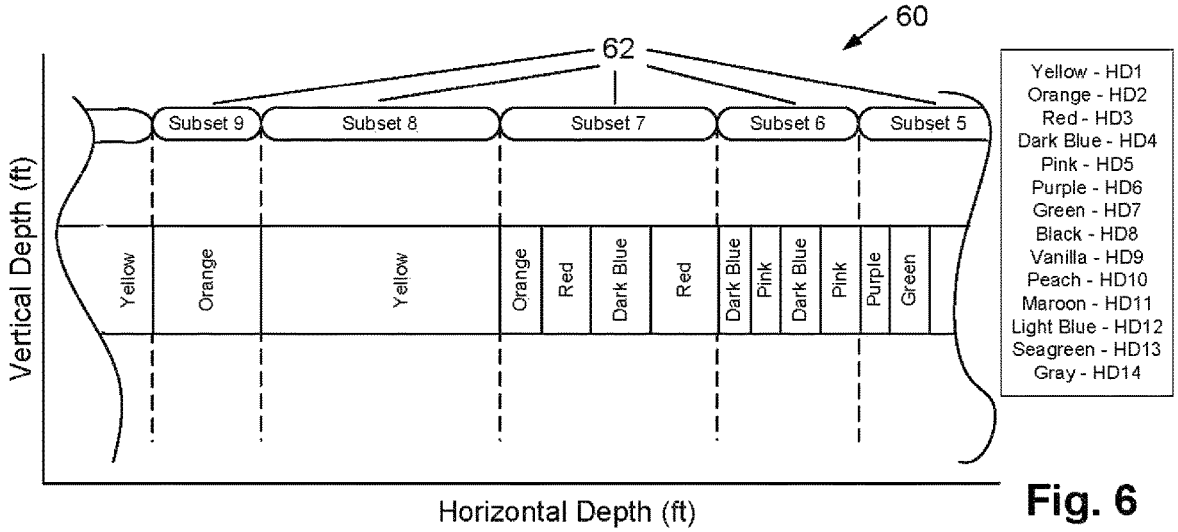
FIG. 6 is a portion of a geomechanical model in which lengths of subsets of the geomechanical model have been demarcated based on MSE values corresponding to a drilling operation of a well.

Turning to FIG. 6, geomechanical model 60 is shown having subsets 62 demarcated based on the groups to which the MSE values of each subset are categorized. More specifically, subsets 62 have been demarcated at positions along the depicted portion of the well corresponding to boundaries of neighboring facies. As shown, the demarcation lines are the same as the demarcation lines determined with respect to geomechanical model 50 shown in FIG. 5. The discussion with respect to FIG. 5 of the particular border lines for each subset with respect to the different facies of the depicted portion of the well is referenced for the subsets depicted in geomechanical model 60 in FIG. 6 and is not reiterated for the sake of brevity. The difference with geomechanical model 60, however, is that the subsets were not demarcated previously and locations of perforation clusters were not defined beforehand. Thus, the demarcation process for geomechanical model 60 is not based on previously designated locations of perforation clusters. As noted for subsets 59 in FIG. 5, subsets 62 in geomechanical model 60 may be demarcated in a different manner than depicted in FIG. 6, particularly that the borders of the subsets may be demarcated to different interfaces between neighboring facies along the well or even demarcated to a location within a single facie.

Figure 7:
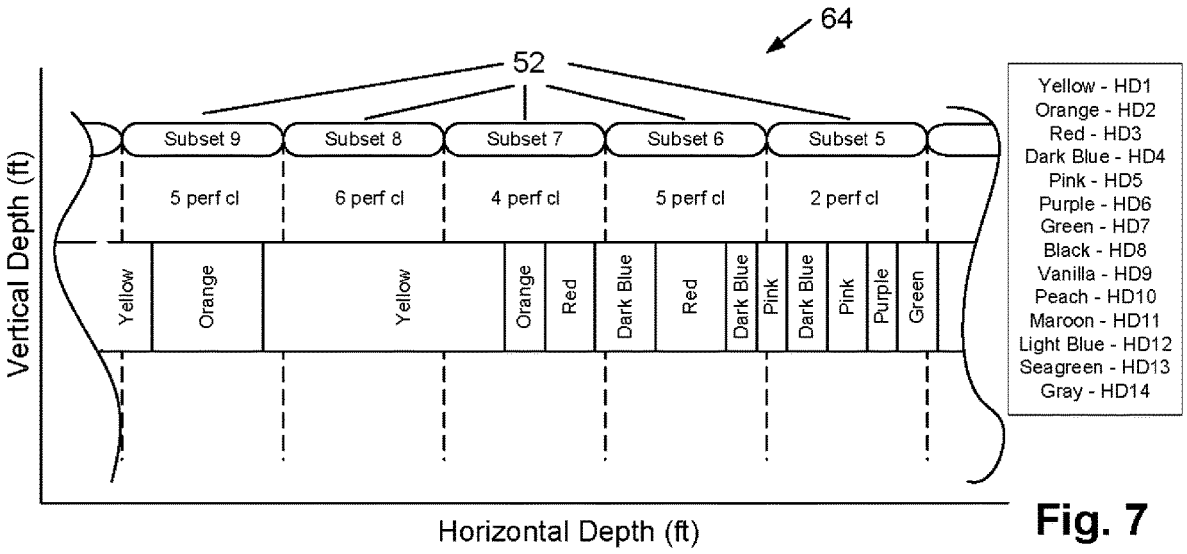
FIG. 7 is a portion of a geomechanical model in which quantities of perforation clusters of a well completion design have been designated per subset of the geomechanical model based on MSE values corresponding to a drilling operation of a well.

FIG. 7 illustrates geomechanical model 64 geometrically divided into subsets 52 of equal length as was done for geomechanical model 50 depicted in FIG. 4. In an alternative embodiments, geomechanical model 64 may include subsets demarcated based on the groups to which the MSE values of each subset are categorized, such as was done for geomechanical model 60 depicted in FIG. 6. Either scenario may be generally referred to as demarcating subsets along the portion of the drilled well for determining one or more parameters of a well completion design. In any case, FIG. 7 further illustrates a particular number of perforation clusters designated for each of the subsets. In particular, FIG. 7 illustrates subsets 5 and 6 having two and five perforation clusters respectively designated thereto. In addition, FIG. 7 illustrates subsets 7-9 respectively having four, six and five perforation clusters assigned thereto.

In some cases, the designated quantity of perforation clusters for a subset in FIG. 7 may be based on a composite length of one or more particular facies within the subset. As noted above, one of the largest contributors to the variability of well production is the variation in stress between neighboring perforation clusters (i.e., larger variations of stress between neighboring perforation clusters generally yield lower production). Thus, it would be advantageous to base the number perforation clusters within a subset to that which may fit within a single type of facie within a subset or two facie types within a subset having groups of MSE values which neighbor each other along the scale to which they are categorized. Such a process may be beneficial for optimizing production from each subset rather than assigning the same number of perforation clusters per subset as done in many conventional well completion designs. For example, the designation of two perforation clusters in subset 5 may be based on the composite length of the neighboring pink and purples MSE groups therein. In addition, the designation of five perforation clusters in subset 6 may be based on the composite length of the two dark blue MSE groups and the intervening red MSE group therein. Moreover, the designation of four perforation clusters in subset 7 may be based on the composite length of the red and orange MSE groups therein or the orange and yellow MSE groups therein. On the contrary, the respective designations of six and five perforation clusters in subsets 8 and 9 may be based on the length of a single MSE group in each subset, particularly the yellow MSE group in subset 8 and the orange MSE group in subset 9.

Figure 8:
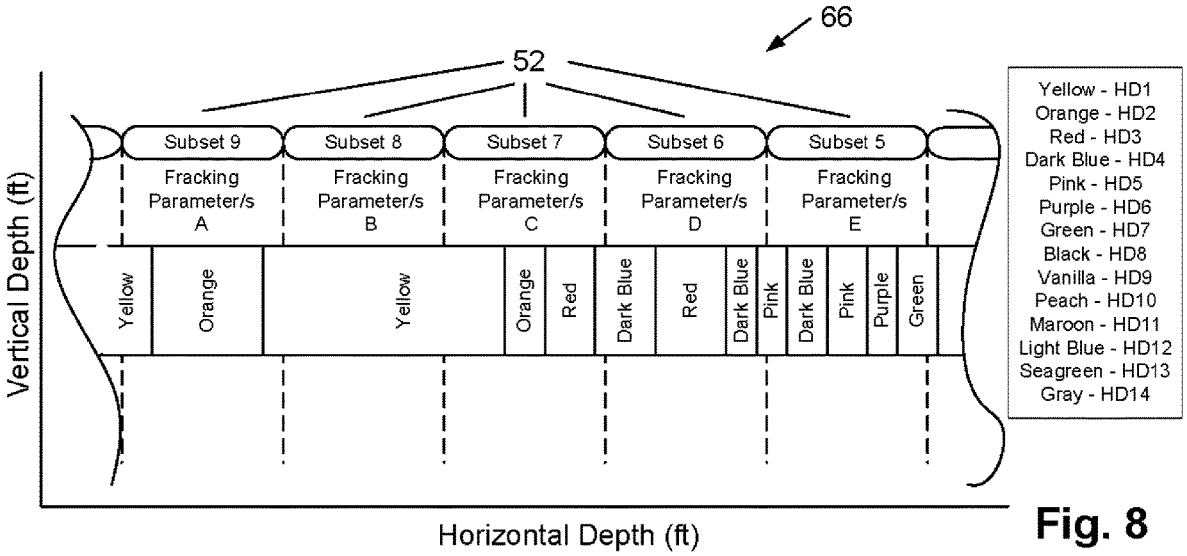
FIG. 8 is a portion of a geomechanical model in which one or more fracking parameters of a fracking operation of a well completion design have been defined per fracking stage of the geomechanical model based on MSE values corresponding to a drilling operation of a well.

FIG. 8 illustrates geomechanical model 66 geometrically divided into subsets 52 of equal length as was done for geomechanical model 50 depicted in FIG. 4. Similar to geomechanical model 64 described in reference to FIG. 7, geomechanical model 66 may alternatively include subsets demarcated based on the groups to which the MSE values of each subset are categorized, such as was done for geomechanical model 60 depicted in FIG. 6. In any case, FIG. 8 further illustrates specific sets of fracking parameters defined for each of the subsets. In particular, FIG. 8 is specific to a geomechanical model of a well in which hydraulic fracturing is to be performed and, thus, subsets 52 in FIG. 8 represent fracking stages of a well completion design. In addition, FIG. 8 illustrates subsets 5-9 respectively having fracking parameter sets E, D, C, B and A assigned thereto. The defined fracking parameter sets may generally include but are not limited to an amount of hydraulic horsepower, a volume of proppant, one or more types of proppant, a volume of fracking fluid, and one or more types of fracking fluids.

In general, one or more of the parameters of the fracking parameter sets designated in FIG. 8 may be based on identifying one or more facies in a fracking subset in which perforation clusters will be or are already designated (such as described in reference to FIG. 4) and then defining the one or more parameters of the fracking parameters sets based on the range of MSE values for the identified one or more facies. For example, the assignment of fracking parameter sets E, D, C, B and A to subsets 5-9 may be based on the pink and purple MSE groups in subset 5, the two dark blue MSE groups and the intervening red MSE group in subset 6, the red and orange MSE groups or the orange and yellow MSE groups in subset 7, the yellow MSE group in subset 8 and the orange MSE group in subset 9. In some cases, all parameters of a fracking operation may be based on the identified one or more facies. In other embodiments, however, less than all parameters of a fracking operation may be based on the identified one or more facies. In the latter of such cases, the fracking parameters not based on the identified one or facies may be predetermined and the same for all subsets. In any case, defining one or more fracking parameters of individual subsets based on facies of the subset may facilitate hydraulic fracturing operations to generate more productive fractures in rock.

It is noted the example manners of determining parameters of a well completion design described in reference to FIGS. 4-8 are not necessarily mutually exclusive. In particular, any combination of the techniques described in reference to such figures may be used to define parameters of a well completion design of at least a portion of a well. Furthermore, it is noted that parameters of well completion designs other than those disclosed in relation to FIGS. 4-8 may be based on MSE values or groups to which MSE values are categorized.

It will be appreciated to those skilled in the art having the benefit of this disclosure that this invention is believed to provide methods and storage mediums with processor-executable program instructions for determining one or more parameters of a well completion design based on drilling data corresponding to variables of MSE. Further modifications and alternative embodiments of various aspects of the invention will be apparent to those skilled in the art in view of this description. For example, although the methods and storage mediums disclosed herein are emphasized for horizontal oil wells, the methods and storage mediums are not so restricted. In particular, the methods and storage mediums may be used to determine parameter/s of a well completion design of any drilled well from which data related to variables of MSE are available. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims. The term "approximately" as used herein refers to variations of up to +/−5% of the stated number.

What is claimed is:

1. A non-transitory storage medium comprising program instructions which when executed by a processor perform the operations of:

receiving data regarding a drilling operation of a well;

calculating values of mechanical specific energy (MSE) from the received data;

categorizing the MSE values into a plurality of groups according to different ranges of MSE values;

mapping groups to which the MSE values are categorized to locations along the drilled well;

creating a geomechanical model of the mapped groups;

demarcating subsets of the geomechanical model such that lengths of the subsets correspond to sections of the drilled well;

determining one or more parameters of a well completion design for the drilled well using the demarcated subsets of the geomechanical model, wherein the one or more parameters are selected from a group consisting of locations of perforation clusters, quantities of perforation clusters, locations of fracking stages, lengths of fracking stages, and one or more parameters to induce and maintain hydraulic fractures fractures including selecting fracturing fluid type and proppant type; and creating the well completion design with the one or more parameters.

2. The non-transitory storage medium of claim 1, wherein the program instructions for determining the one or more parameters of the well completion design comprise program instructions for individually analyzing the mapped groups of each of the different demarcated subsets.

3. The non-transitory storage medium of claim 1, wherein the program instructions for determining the one or more parameters of the well completion design comprise program instructions for designating locations of perforation clusters along one or more of the demarcated subsets, wherein at least some of designated locations are arranged along a portion of a demarcated subset having associated MSE values of the same group.

4. The non-transitory storage medium of claim 1, wherein the different ranges of MSE values represent different facies of rock, and wherein the program instructions for determining the one or more parameters of the well completion design comprise program instructions for delineating fracking stages at positions along the geomechanical model corresponding to boundaries of neighboring facies.

5. The non-transitory storage medium of claim 1, wherein the different ranges of MSE values represent different facies of rock, and wherein the program instructions for determining the one or more parameters of the well completion design comprise program instructions for designating a number of perforation clusters for each of one or more of the demarcated subsets, wherein the designated number for at least one of the one or more demarcated subsets is based on a composite length of one or more particular facies within the respective demarcated subset and/or geomechanical properties of the one or more particular facies.

6. The non-transitory storage medium of claim 1, wherein the different ranges of MSE values represent different facies of rock, and wherein the program instructions for determining the one or more parameters of the well completion design comprise program instructions for:

delineating one or more fracking stages along the geomechanical model;

identifying a single facie in one of the fracking stages in which perforation clusters are designated;

defining one or more parameters of a fracking operation for the one fracking stage based on the range of MSE values associated with the identified facie; and conducting the steps of identifying a single facie and defining one or more parameters of a fracking operation for other fracking stages of the one or more fracking stages.

7. The non-transitory storage medium of claim 1, further comprising program instructions for amending and/or removing at least some of the received data that correlates to distortions of the received data which are not related to geomechanical properties of rock drilled in the well, wherein the program instructions for calculating the values of MSE comprise program instructions for calculating the MSE values with the received data subsequent to amending and/or removing at least some of the received data.

8. The non-transitory storage medium of claim 1, wherein the received data comprises:

first data for variables used to calculate the MSE values; and second data which does not include variables of the calculated MSE values, and wherein the non-transitory storage medium further comprises program instructions for amending at least some of the first data with respect to the second data prior to calculating the MSE values.

9. The non-transitory storage medium of claim 1, wherein the received data comprises auxiliary data which does not include variables of the calculated MSE values, and wherein the storage medium comprises program instructions which are executable by a processor for amending the geomechanical model with respect to the auxiliary data prior to demarcating subsets of the geomechanical model.

10. The non-transitory storage medium of claim 1, wherein the well is a production well, wherein the geomechanical model comprises delineated parameters for recompletion of the production well, and wherein the program instructions for creating the geomechanical model comprises program instructions for creating the geomechanical model based at least in part on the calculated MSE values and locations of perforation clusters created during an initial well completion of the production well.

11. The non-transitory storage medium of claim 1, wherein the one or more parameters to induce and maintain hydraulic fractures are selected from a group consisting of locations of fracking stages, lengths of fracking stages, hydraulic horsepower, volume of proppant, one or more types of proppant, volume of fracking fluid, one or more types of fracking fluids and placement of fracturing sleeves.

12. The non-transitory storage medium of claim 1, wherein the program instructions for demarcating subsets of the geomechanical model comprise demarcating subsets at boundaries of neighboring mapped groups.

13. The non-transitory storage medium of claim 1, wherein the program instructions for demarcating subsets of the geomechanical model comprise demarcating subsets of one or more set lengths along the geomechanical model.

14. A method, comprising:

acquiring values of mechanical specific energy (MSE) for at least a portion of a drilled well;

categorizing the MSE values into a plurality of groups according to different ranges of MSE values;

mapping groups to which the MSE values are categorized to locations along the drilled well;

creating a geomechanical model of the mapped groups;

demarcating subsets of the geomechanical model such that lengths of the subsets correspond to sections of the drilled well;

determining one or more parameters of a well completion design for the drilled well using the demarcated subsets of the geomechanical model, wherein the one or more parameters are selected from a group consisting of locations of perforation clusters, quantities of perforation clusters, locations of fracking stages, lengths of fracking stages, and one or more parameters to induce and maintain hydraulic fractures fractures including selecting fracturing fluid type and proppant type; and creating the well completion design with the one or more parameters.

15. The method of claim 14, wherein the step of determining the one or more parameters comprises individually analyzing the mapped groups of each of the different demarcated subsets.

16. The method of claim 14, wherein the step of determining the one or more parameters of the well completion design comprises designating locations of perforation clusters along one or more of the demarcated subsets, wherein at least some of designated locations along at least one of the one or more demarcated subsets have associated MSE values of the same group.

17. The method of claim 16, wherein the demarcated subsets are used to select fracking stages.

18. The method of claim 17, wherein the step of determining the one or more parameters further comprises amending the fracking stages subsequent to designating the locations of perforation clusters.

19. The method of claim 14, wherein the different ranges of MSE values represent different facies of rock, and wherein the step of determining the one or more parameters of the well completion design comprises delineating fracking stages at positions along the well completion design corresponding to boundaries of neighboring facies.

20. The method of claim 14, wherein the different ranges of MSE values represent different facies of rock, and wherein the step of determining the one or more parameters of the well completion design comprises designating a number of perforation clusters for one or more of the demarcated subsets, wherein the designated number for at least one of the one or more demarcated subsets is based on a composite length of one or more particular facies within the respective demarcated subset and/or geomechanical properties of the one or more particular facies.

21. The method of claim 14, wherein the drilled well is a production well, and wherein the step of determining one or more parameters comprises determining one or more parameters of a well recompletion design for at least a portion of the production well based on the MSE values and locations of perforation clusters created during an initial well completion of the production well.

22. The method of claim 14, wherein the step of acquiring values of MSE comprises:

acquiring first data regarding a drilling operation of the well;

analyzing the first data to identify distortions among the first data which are not related to geomechanical properties of rock drilled in the well;

amending and/or removing some of the first data that correlates to the distortions; and calculating the MSE values with the first data subsequent to amending at least some of the first data.

23. The method of claim 22, further comprising:

acquiring second data regarding the drilling operation but which does not include variables of the calculated MSE values; and amending at least some of the first data with respect to the second data prior to calculating the MSE values.

24. The method of claim 14, further comprising:

acquiring data regarding a drilling operation of the well but which does not include variables of the calculated MSE values; and amending the geomechanical model with respect to the data.

25. The method of claim 14, wherein the one or more parameters to induce and maintain hydraulic fractures are selected from a group consisting of locations of fracking stages, lengths of fracking stages, hydraulic horsepower, volume of proppant, one or more types of proppant, volume of fracking fluid, one or more types of fracking fluids and placement of fracturing sleeves.

26. The method of claim 14, wherein the step of demarcating subsets of the geomechanical model comprise demarcating subsets at boundaries of neighboring mapped groups.

27. The method of claim 14, wherein the step of demarcating subsets of the geomechanical model comprise demarcating subsets of one or more set lengths along the geomechanical model.

* * * * *